US008182004B2

(12) United States Patent
Yoda

(10) Patent No.: US 8,182,004 B2
(45) Date of Patent: May 22, 2012

(54) VEHICLE DOOR LATCH APPARATUS

(75) Inventor: Yuji Yoda, Kanagawa (JP)

(73) Assignee: Mitsui Kinzoku Act Corporation, Yokohama-shi (JP)

( * ) Notice: Subject to any disclaimer, the term of this patent is extended or adjusted under 35 U.S.C. 154(b) by 741 days.

(21) Appl. No.: 12/314,983

(22) Filed: Dec. 19, 2008

(65) Prior Publication Data

US 2009/0160198 A1 Jun. 25, 2009

(30) Foreign Application Priority Data

Dec. 20, 2007 (JP) ..... 2007-328659

(51) Int. Cl.
*E05C 3/06* (2006.01)

(52) U.S. Cl. ..... 292/201; 292/216; 292/DIG. 23; 70/470; 70/469

(58) Field of Classification Search ..... 292/201, 292/216, DIG. 23
See application file for complete search history.

(56) References Cited

U.S. PATENT DOCUMENTS

| | | | | |
|---|---|---|---|---|
| 6,053,543 | A * | 4/2000 | Arabia et al. | 292/201 |
| 6,511,106 | B2 * | 1/2003 | Perkins et al. | 292/216 |
| 6,517,128 | B2 * | 2/2003 | Perkins et al. | 292/216 |
| 7,055,872 | B2 * | 6/2006 | Hayakawa et al. | 292/216 |
| 2002/0096889 | A1 * | 7/2002 | Nelsen et al. | 292/201 |
| 2002/0096890 | A1 * | 7/2002 | Cetnar et al. | 292/201 |
| 2005/0179265 | A1 * | 8/2005 | Bendel et al. | 292/216 |

FOREIGN PATENT DOCUMENTS

| | | |
|---|---|---|
| JP | 11-041858 | 2/1999 |
| JP | 2002-021400 | 1/2002 |
| JP | 2005-282221 | 10/2005 |

OTHER PUBLICATIONS

Office Action mailed Oct. 27, 2009 in Japan Application No. 2007-328659, with translation (10 pgs).

* cited by examiner

*Primary Examiner* — Thomas Beach
*Assistant Examiner* — Sajid R Ansari
(74) *Attorney, Agent, or Firm* — Foley & Lardner LLP

(57) ABSTRACT

An operating mechanism unit includes a motor, a worm wheel being rotated by the motor, a sector gear meshing with a pinion provided on one side of the worm wheel and rotating to an unlocking position and a locking position, switch levers connected to the sector gear and shifting to an unlocking position where engagement with a meshing mechanism is releasable and a locking position where the engagement cannot be released, and a key sub-lever pivotally supported on the same pivot on which the sector gear pivots. The key sub-lever is rotatable from a neutral position in an unlocking direction and a locking direction in synchronism with operation of a key cylinder so as to rotate the sector gear to the unlocking position by rotating in the unlocking direction and to rotate the sector gear in the locking direction by rotating in the locking direction.

12 Claims, 10 Drawing Sheets

VEHICLE DOOR LATCH APPARATUS

This application claims priority from Japanese Patent Application No. 2007-328659 filed on Dec. 20, 2007, the entire subject matter of which is incorporated herein by reference.

BACKGROUND OF THE INVENTION

1. Field of the Invention

The present invention relates to a vehicle door latch apparatus including a meshing mechanism unit and an operating mechanism unit which can control the meshing mechanism unit.

2. Description of the Related Art

A vehicle door latch apparatus includes a meshing mechanism unit which can be engaged with and disengaged from a striker on a body side and an operating mechanism unit which can control the meshing mechanism unit. For example, a related vehicle door latch apparatus disclosed in JP-A-2005-282221 includes an operating mechanism unit having a key lever, a key link and a key sub-lever which operate in such a manner as to follow the operation of a key cylinder provided on an external side of a door, a sector gear which operates in such a manner as to follow the rotation of a motor, a lock lever which is connected to a lock knob provided on an internal side of the door, and a link lever which is connected to the sector gear. Accordingly, the related vehicle door latch apparatus enables or disables opening of the door through operation of a door opening operation handle provided on the door by the link lever linked with the sector gear shifting from an unlocking position where the link lever can be brought into engagement with a ratchet lever of the meshing mechanism unit to a locking position where the link lever is disabled from engaging with the ratchet lever or shifting reversely based on a manual operation of the key cylinder or the lock knob or powered operation by virtue of motor drive.

In the related vehicle door latch apparatus described above, the key sub-lever and the lock lever are pivotally supported so as to rotate on the same pivot, and the sector gear is pivotally supported by the separate pivot in the different position from where the key sub-lever is pivotally supported, whereby the key sub-lever is connected to the sector gear via a connection lever (for example, refer to FIG. 3 of JP-A-2005-282221). Because of this, the sector gear, the connection-lever and the key sub-lever are disposed in the different positions, and an operation space where individual operations of the sector gear, the connection lever and the key sub-lever are permitted has to be secured within a cover which accommodates the respective levers of the operation mechanism portion. This eventually increases a front projection area of the operating mechanism unit (i.e., the area of the operating mechanism unit shown in FIG. 3 of JP-A-2005-282221). Thus, the operating mechanism unit may become enlarged.

SUMMARY OF THE INVENTION

An object of the invention is to provide a vehicle door latch apparatus that is capable of reducing a size of an operating mechanism unit thereof.

According to a first aspect of the invention, there is provided a vehicle door latch apparatus comprising: a meshing mechanism unit that is configured to engage with and disengage from a striker provided on a vehicle body; an operating mechanism unit that is configured to operate the meshing mechanism unit, the operating mechanism unit comprising: a gearwheel comprising a pinion on one side thereof; a motor that rotates the gearwheel; a sector gear, which is pivotally supported by a pivot, which meshes with the pinion, and which is rotated by the pinion of the gearwheel; a switch lever, which is connected to the sector gear, and which is shiftable to: an unlocking position where engagement between the meshing mechanism unit and the striker is releasable; and a locking position where the engagement is unreleasable; and a key sub-lever, which is pivotally supported on the pivot, which is rotatable in an unlocking direction and a locking direction in synchronism with operations of a operation key cylinder provided on an external side of a door, and which is configured to: rotate the sector gear to the unlocking position by rotating in the unlocking direction; and rotate the sector gear in the locking direction by rotating in the locking direction.

According to a second aspect of the invention, in the vehicle door latch apparatus, the sector gear comprises the key sub-lever on a first side thereof, and the sector gear is provided such that the first side of the sector gear faces the one side of the gearwheel.

According to a third aspect of the invention, in the vehicle door latch apparatus, the operating mechanism unit further comprises: a lock lever, which is pivotally supported on the pivot so as to rotate together with the sector gear, and which is linked with a lock knob provided on an internal side of the door, wherein the lock lever is provided on a second side, which is opposite to the first side, of the sector gear.

According to a fourth aspect of the invention, in the vehicle door latch apparatus, the sector gear, the key-sub lever and the lock lever are pivotally supported on the pivot such that the key-sub lever rotates independently of the sector gear and the lock lever rotates together with the sector gear.

According to a fifth aspect of the invention, in the vehicle door latch apparatus, the operating mechanism unit further comprises a body, the meshing mechanism unit is pivotally fixed to the body, the meshing mechanism unit further comprising: a latch, which is pivotally fixed to the body, and which is engagable with a striker secured to the vehicle body; and a latchet, which is pivotally fixed to the body, which is engagable with and disengagable from the latch, and which comprises an engagement pin at a rotating end portion thereof, and the engagement pin is engagable with the switch lever.

According to a sixth aspect of the invention, in the vehicle door latch apparatus, the switch lever is movable in a direction in which the switch lever engages with the engagement pin when the sector gear and the switch lever are in the locking position, and the switch lever is movable in a direction in which the switch lever fails to engage with the engagement pin when the sector gear and the switch lever are in the unlocking position.

According to a seventh aspect of the invention, in the vehicle door latch apparatus, the sector gear comprises a projecting portion on one side thereof, and the switch lever is operated to follow a rotation of the sector gear, the switch lever comprising: a first switch lever comprising an elongated hole that is brought into slidable engagement with the projecting portion of the sector gear; and a second switch lever that is rotatable independently of the first switch lever and is engagable with the engagement pin.

According to an eighth aspect of the invention, in the vehicle door latch apparatus, the operating mechanism unit further comprises a lock lever that is pivotally supported on the pivot, and the sector gear, the key-sub lever and the lock lever are pivotally supported on the pivot such that the lock lever is provided on the one side of the sector gear and the key-sub lever is provided on the other side of the sector gear, the other side of the sector gear facing the one side of the gearwheel.

According to a ninth aspect of the invention, in the vehicle door latch apparatus, the operating mechanism unit further comprises: a body, to which the meshing mechanism is pivotally fixed; a cover for covering one side of the body; and an outside lever that is pivotally supported within the cover, the switch lever being connected to an end portion of the outside lever; and an inside lever, which is pivotally supported within the cover, and which is abuttable with the outside lever.

According to the aspects of the invention, an operation space where the operation of the key sub-lever is permitted can be encompassed within an operation space where the operation of the sector gear is permitted. As a result, the necessity is obviated of securing separately the operation space of the key sub-lever outside the operation space of the sector gear, whereby the front projection area of the operating mechanism unit can be reduced, thereby making it possible to realize a reduction in size of the operating mechanism unit.

In addition, according to the second aspect of the invention, the sector gear and the key sub-lever can be disposed on the same plane, and the thickness of the operating mechanism unit can be reduced.

Further, according to the third aspect of the invention, an operating force transmission member for connecting the lock lever to the lock knob can be connected simply.

According to the vehicle door latch apparatus of the invention, the operation space where the operation of the key sub-lever is permitted can be encompassed within the operation space where the operation of the sector gear is permitted. Therefore, it is possible to reduce the front projection area of the operating mechanism unit, and thus it is possible to reduce a size of the operating mechanism unit.

DETAILED DESCRIPTION OF THE PREFERRED EMBODIMENTS

Figure 1:
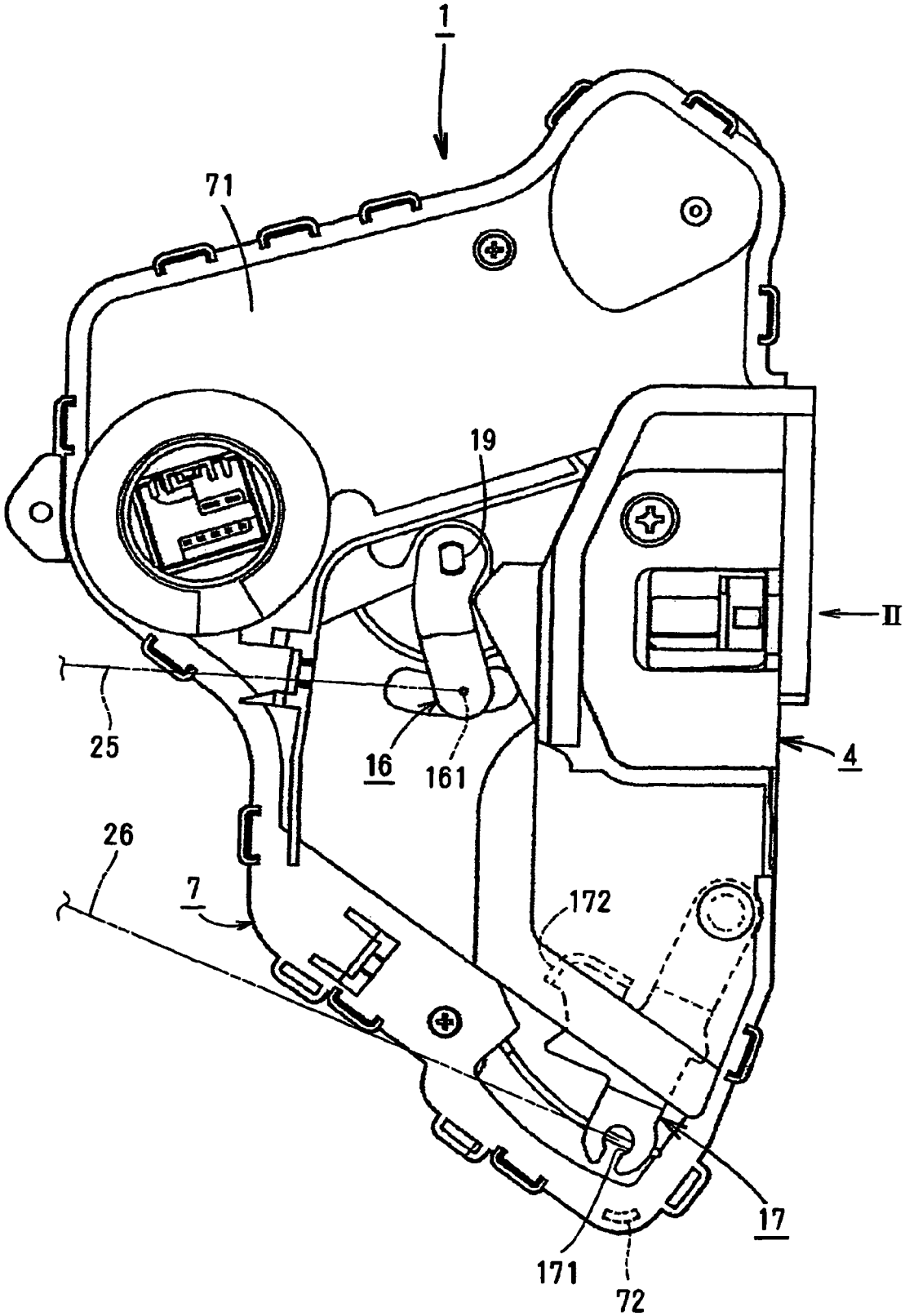
FIG. 1 is a front view of a door latch apparatus to which an embodiment of the invention is applied.
Figure 2:
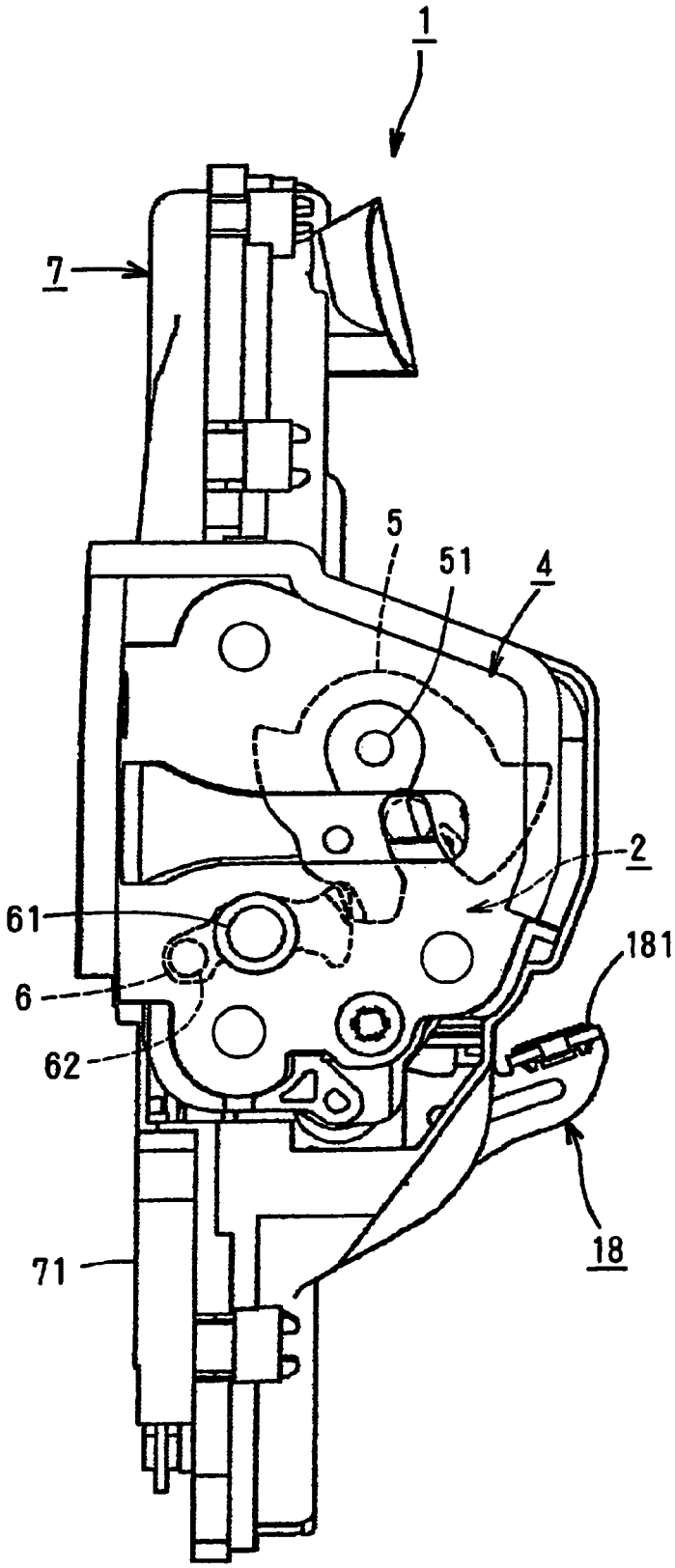
FIG. 2 is a view as seen from a direction indicated by an arrow II in FIG. 1.
Figure 3:
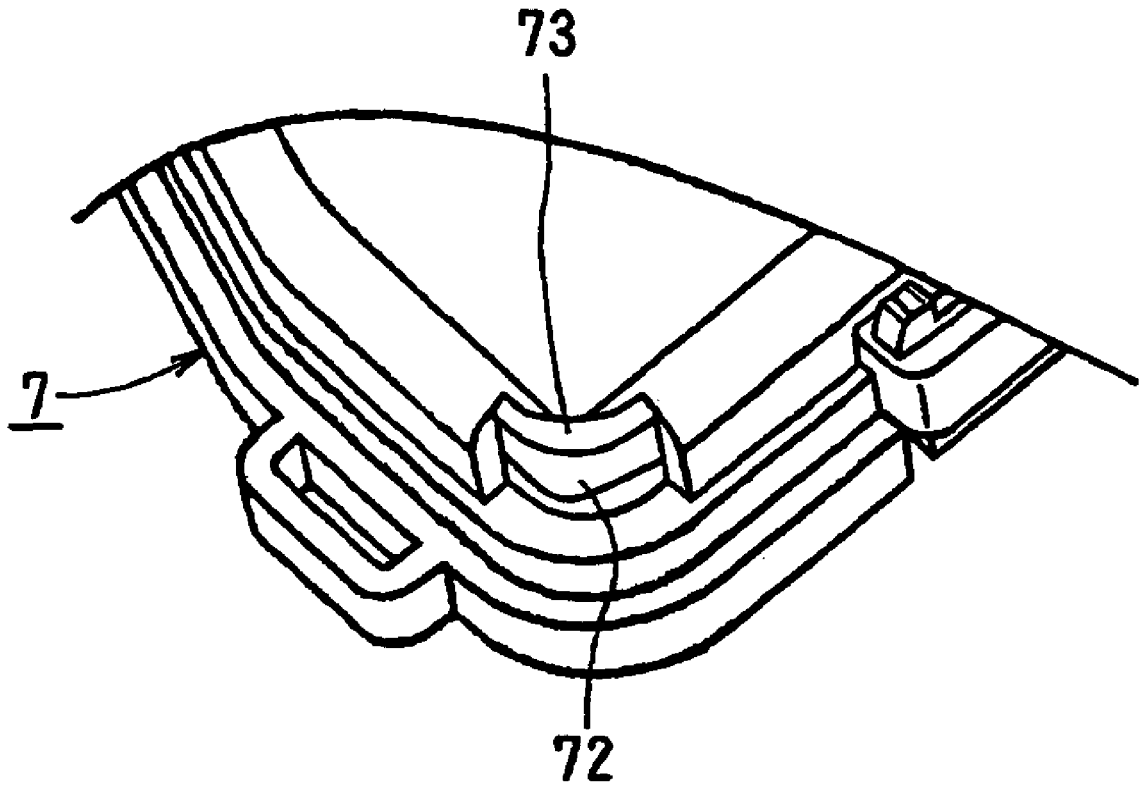
FIG. 3 is an enlarged view of a main part of a cover.
Figure 4:
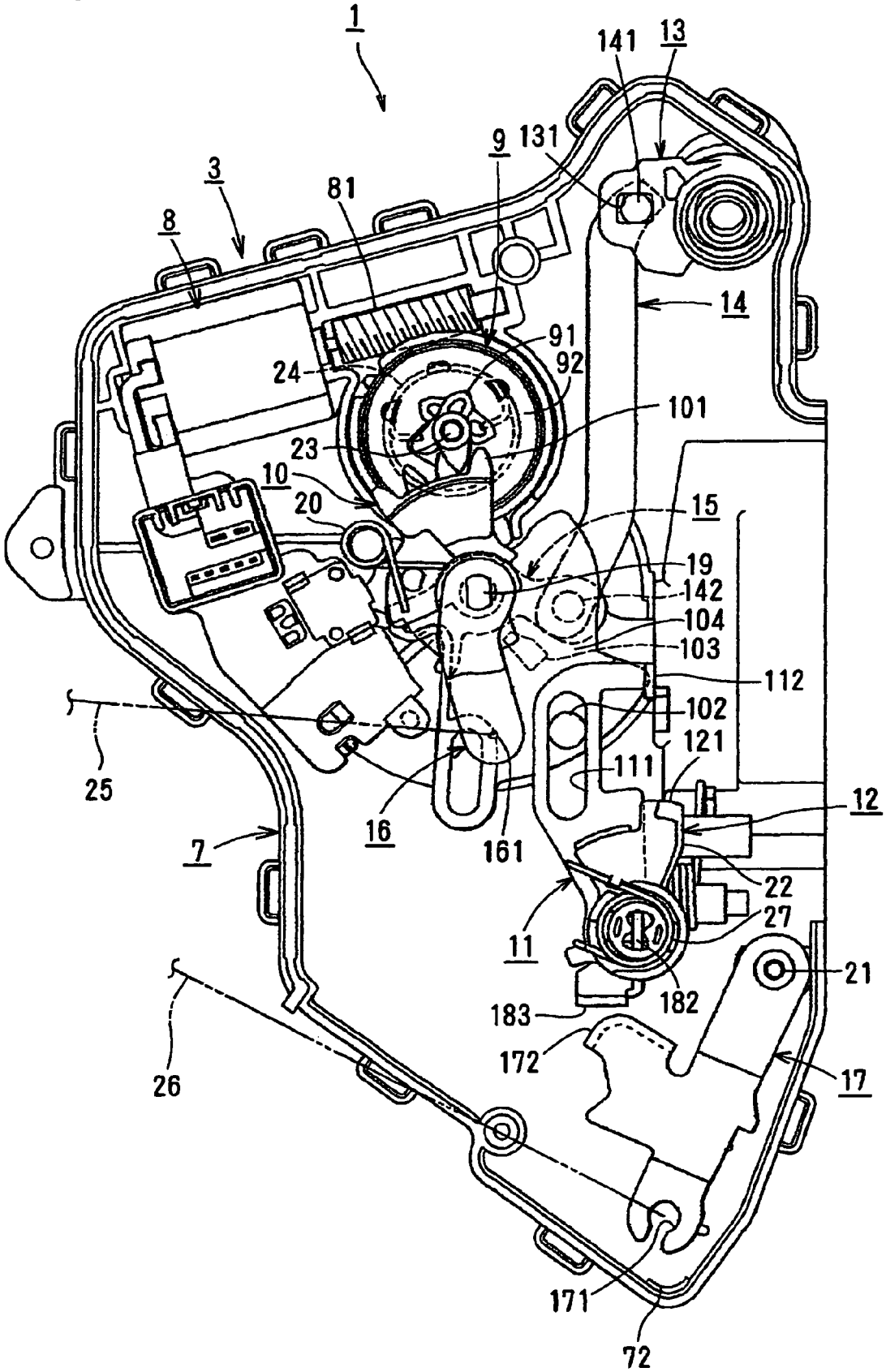
FIG. 4 is a front view of an operating mechanism unit when the door latch apparatus is in an unlocking state.
Figure 5:
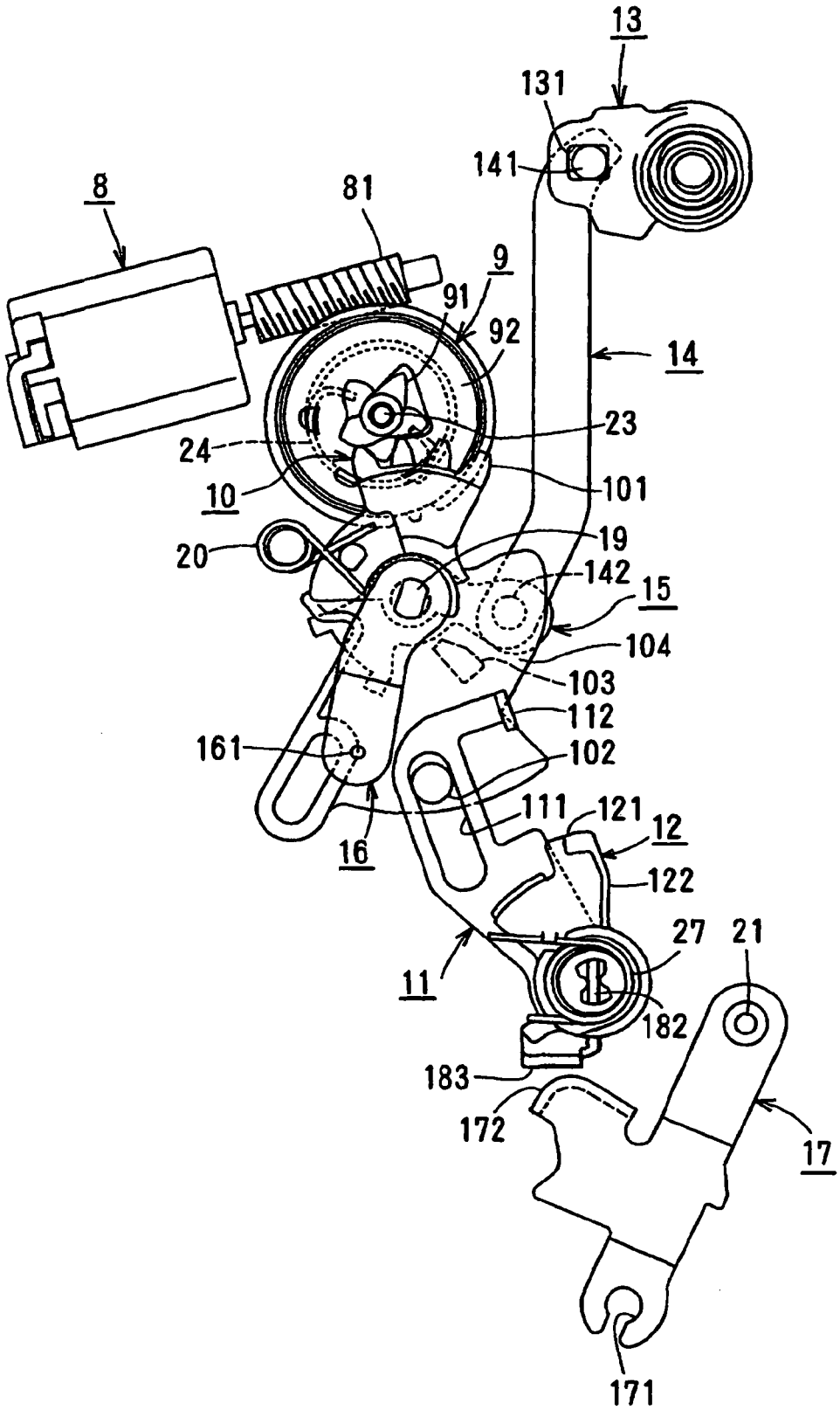
FIG. 5 is a front view of the operating mechanism unit when the door latch apparatus is in a locking state.
Figure 6:
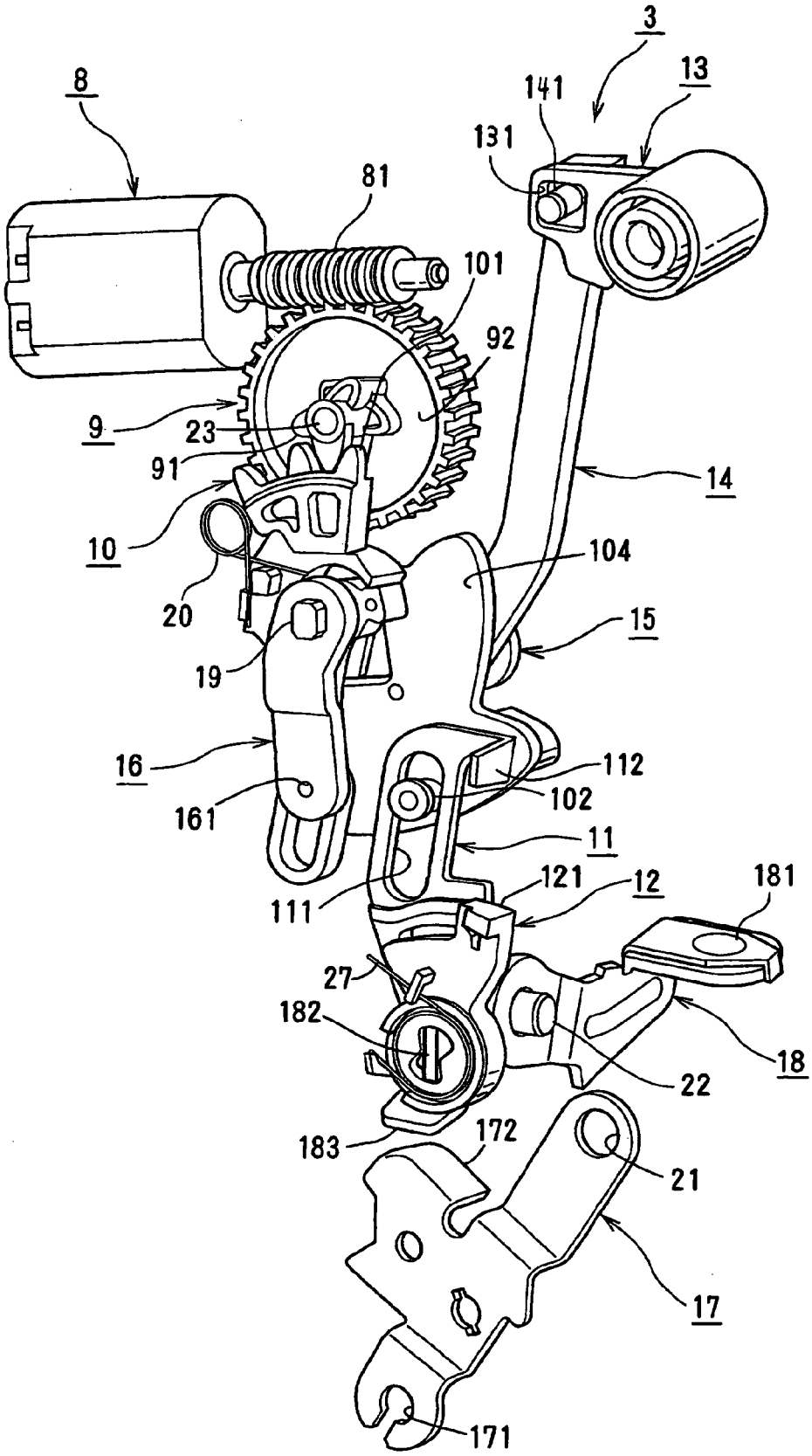
FIG. 6 is a perspective view of the operating mechanism unit.
Figure 11:
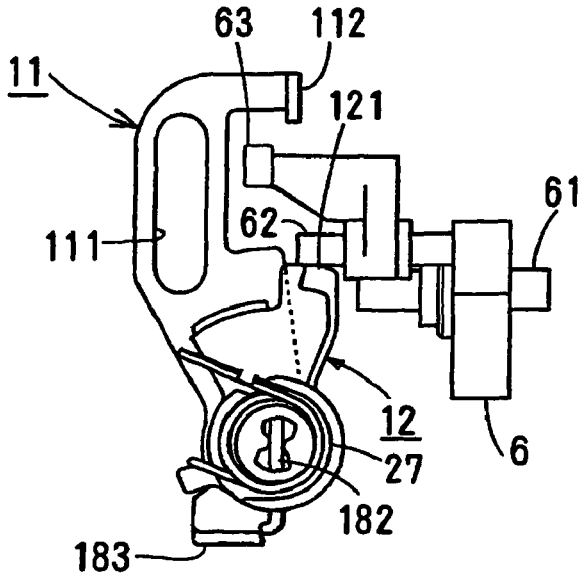
FIG. 11 is a front view of main parts of the operating mechanism unit and a meshing mechanism unit when first and second switch levers operate in unlocking directions.
Figure 12:
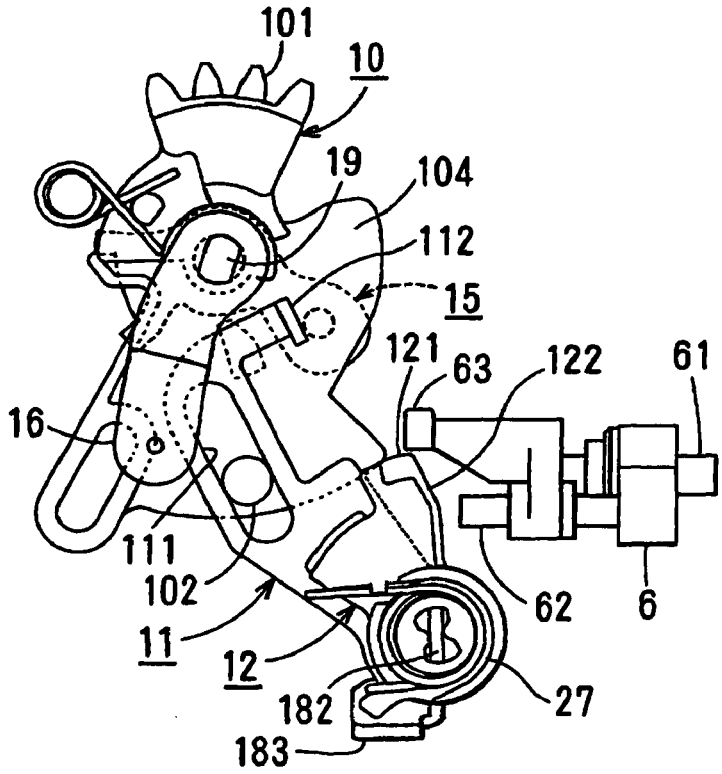
FIG. 12 is a front view of the main parts of the operating mechanism unit and the meshing mechanism unit when the first and second switch levers fail to establish engagement.
Figure 13:
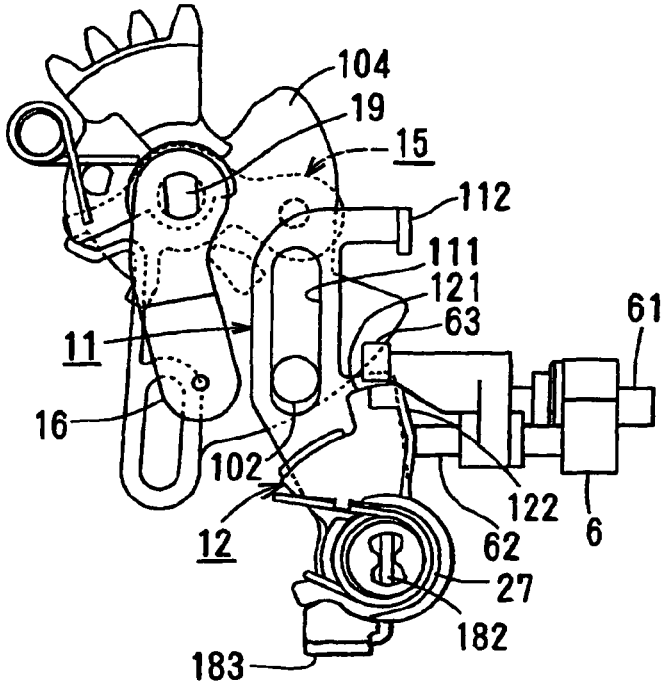
FIG. 13 is a front view of the main parts of the operating mechanism unit and the meshing mechanism unit when the sector gear rotates to the unlocking position at the same time as the first and second shift levers fail to establish engagement.
Figure 14:
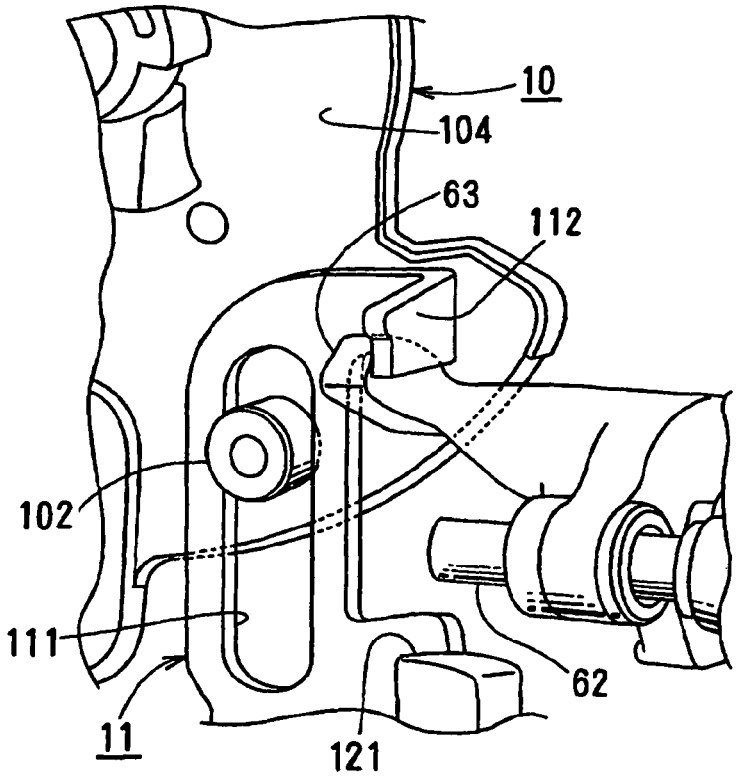
FIG. 14 is a perspective view of the main parts of the operating mechanism unit and the meshing mechanism unit when a door is opened.

An embodiment of the invention will now be described with reference to the drawings. FIG. 1 is a front view of a door latch apparatus according to an embodiment of the invention, FIG. 2 is a view as seen from a direction indicated by an arrow II in FIG. 1, FIG. 3 is an enlarged view of a main part, FIG. 4 is a front view of an operating mechanism unit when in an unlocked state, FIG. 5 is a front view of the operating mechanism unit when in a locked state, FIG. 6 is a perspective view of the operating mechanism unit, FIGS. 7 to 10 are rear views of a main part which illustrate respective controlling states in the operating mechanism unit, FIGS. 11 to 13 are front views of main parts which illustrate respective controlling states in the operating mechanism unit and a meshing mechanism unit, and FIG. 14 is a perspective view of a main part illustrating a controlling state of the operating mechanism unit. Incidentally, in the following description, left in FIGS. 1, 4, 5 and a far side of a drawing in FIG. 2 are referred to as "front," right in FIGS. 1, 4, 5 and a near side of the drawing in FIG. 2 are referred to as "rear," a far side of a drawing in FIGS. 1, 4, 5 and right in FIG. 2 are referred to as an "external side," and a near side of the drawing in FIGS. 1, 4, 5 and left in FIG. 2 are referred to as an "internal side."

A door latch apparatus 1 includes a meshing mechanism unit 2 which is mounted in an interior of a rear end of a front side door (hereinafter, referred to as a door) of a vehicle for holding the door in a closed state and an operating mechanism unit 3 which operates the meshing mechanism unit 2.

As is shown in FIG. 2, the meshing mechanism unit 2 is pivotally fixed by a pivot 51 which is oriented in a longitudinal direction of a vehicle within a body 4 which is fixed in place within a door with a plurality of bolts (not shown) and is configure to accommodate therein a latch 5 which is able to be brought into engagement with a striker (not shown) which is secured to a body side and a ratchet 6 which is pivotally fixed by a pivot 61 and is able to be engaged with and disengaged from the latch 5. By this configuration, when the door is closed, the striker is brought into engagement with the latch 5 and the ratchet 6 is brought into engagement with the latch 5 in such a manner as to prevent the latch 5 from rotating in an opening direction thereof (in a clockwise direction in FIG. 2) in order to hold the door in a closed state. In addition, by the ratchet 6 being rotated in a releasing direction (a clockwise direction in FIG. 2) so as to be disengaged from the latch 5 based on operation of an outside handle (not shown) which is provided on an external side of the door to be operated for opening the door or an inside handle (not shown) which is provided on an internal side of the door to be operated for opening the door, the engagement of the latch 5 with the striker is released so as to enable the door to be opened.

When the door is in the closed state, the ratchet 6 is in engagement with the latch 5 and is in an engagement position shown in FIG. 2. When the door is in an open state with the latch 5 in an open position (a position lying apart almost 90 degrees in the clockwise direction from a closed position shown in FIG. 2), the ratchet 6 is brought into abutment with an outer circumferential edge of the latch 5 and is thereby held in an open position which lies apart almost 90 degrees in the clockwise direction from the closed position shown in FIG. 2).

An engagement pin 62 is implanted in a rotating end portion of the ratchet 6 in such a manner as to project forwards or towards the operating mechanism unit 3 side so as to be brought into engagement with a release portion 121 of a second switch lever 12, which will be described later (refer to FIGS. 11 to 14). In addition, a rotation preventive piece 63 is fixed to the engagement pin 62 in such a manner as to be brought into engagement with a bent piece 112 of a first switch lever 11, which will be described later, so as to prevent the rotation of the first switch lever 11 in a locking direction (refer to FIG. 14).

As shown in FIG. 4 to 6, the operating mechanism unit 3 includes: a cover 7 made from a synthetic resin which is attached in such a manner as to cover a front side of the body 4; a motor 8 which can be caused to rotate forwards and backwards by an operation switch such as a portable remote control switch or a switch (not shown) provided on the door; a worm wheel (a gearwheel) 9 which meshes with a worm 81 provided on the motor 8; a sector gear 10 which operates in such a manner as to follow the rotation of the worm wheel 9; the first and second switch levers 11, 12 which operated in such a manner as to follow the rotation of the sector gear 10; a key lever 13 which is connected to a locking and unlocking key cylinder (not shown) provided on the external side of the door via a rod-shaped connecting rod (not shown); a key link 14 which is connected to the key lever 13; a key sub-lever 15 which is connected to the key link 14; a lock lever 16 which is linked with a locking and unlocking lock knob (not shown) provided on an internal side of the door; an inside lever 17 which is linked with the inside handle; and an outside lever 18 which is linked with the outside handle. Incidentally, in order to clarify compositions within the cover 7, a sub-cover 71, which is made from a synthetic resin, for covering an internal side of the cover 7 is omitted in FIG. 3 (refer to FIGS. 1, 2).

As is mainly shown in FIG. 3, a draining port 72 is provided on an external side of a lowermost portion of the cover 7 which is tapered towards a lower portion thereof for draining the cover 7 or discharging rain water which has intruded into an interior of the cover 7, whereby rain water that has intruded into the interior of the cover 7 is discharged from the draining port 72 in an ensured fashion. In addition, a ledge portion 73 (refer to FIG. 3) is provided on an upper portion of the draining port 72 for preventing the intrusion of rain water which has flowed down along a surface of the cover 7 into the interior thereof.

The worm wheel 9 is pivotally supported at an upper portion in the interior of the case 7 by a pivot 23 which is oriented in a transverse direction of the vehicle and is made to mesh with the worm 81 provided on an output shaft of the motor 8. A pinion 91 is integrally provided on one side 92 of the worm wheel 9 which is oriented inwards of the vehicle in such a manner as to mesh with a toothed portion 101 of the sector gear 10. A neutral return spring 24 for biasing the worm wheel 9 to a neutral position (refer to FIGS. 4, 5) is installed between the other side of the worm wheel 9, which is the opposite side to the one side 92 of the worm wheel 9, and the cover 7. The worm wheel 9 rotates in an unlocking direction (a clockwise direction in FIGS. 4, 5) (or in a locking direction (a counterclockwise direction in FIGS. 4, 5) from the neutral position against the biasing force of the neutral return spring 24 when the motor 8 rotates forwards (or backwards), and when the motor 8 stops after the worm wheel 9 has been made to rotate to an unlocking position or a locking position, the worm wheel 9 is caused to return to the neutral position again by the neutral return spring 24 at a point in time when the motor 8 so stops.

The sector gear 10 is pivotally supported within the cover 7 by a pivot 19 which is oriented in the transverse direction in such a manner as to rotate within a predetermined range. The sector gear 10 includes the toothed portion 101, which is provided at an upper portion thereof which confronts the one side 92 of the worm wheel 9, and which meshes with the pinion 91 on the worm wheel 9.

A projecting portion 102 is provided at a lower portion of one side (one example of a second side) 104 of the sector gear 10 which is oriented transversely towards the inside of the vehicle or transversely inwards. An elongated hole 111 provided in the first switch lever 11 can be brought into vertically slidable engagement with the projecting portion 102. In addition, an abutment portion 103 is provided on the other side (one example of a first side) 105 of the sector gear 10 which is opposite to the one side 104 and is oriented transversely towards the outside of the vehicle or transversely outwards in such a manner as to be brought into abutment with an unlocking abutment portion 151 and a locking abutment portion 152, both of which will described later, of the key sub-lever 15 (refer to FIGS. 7 to 9).

The sector gear 10 is caused to rotate to an unlocking position (refer to FIG. 4) and a locking position (refer to FIG. 5) based on either a powered operation by virtue of the drive of the motor 8 or a manual operation via the key cylinder and the lock knob and is elastically held in the respective positions by virtue of the biasing force of a spring 20 which is supported within the cover 7. In addition, a meshing relationship between the toothed portion 101 of the sector gear 10 and the pinion 91 of the worm wheel 9 is such that when the worm wheel 9 rotates from the neutral position, the pinion 91 can mesh with the toothed portion 101, whereas when the sector gear 10 initiates rotation rather than the worm wheel 9 does, the toothed portion 101 is made not to mesh with the pinion 91. By this configuration, when the manual operation is performed, the sector gear 10 can be rotated to the respective positions without being subjected to resistance which rotates the worm wheel 9 and the motor 8 in the reverse direction. For example, when the worm wheel 9 is in a position where the pinion 91 contacts the rear-end toothed portion 101 as shown in FIG. 4, the sector gear 10 can be movable toward a position where the front-end toothed portion 101 contacts the pinion 91. When the worm wheel 9 rotates counterclockwise direction in FIG. 4, the pinion 91 of the worm wheel 9 can mesh with the toothed portion 101 of the sector gear 10 so as to rotate the sector gear 10 in the clockwise direction in FIG. 4.

The key lever 13 is pivotally supported at an uppermost portion in the interior of the cover 7 in such a manner as to rotate about an axis oriented in the transverse direction. The key lever 13 is held in a neutral position (refer to FIGS. 4, 5) when made inoperable. In contrast, when the key cylinder is operated, the key lever 13 rotates through a predetermined angle from the neutral position in an unlocking direction (a clockwise direction in FIGS. 4, 5) and a locking direction (a counterclockwise direction in FIGS. 4, 5).

The key link 14 includes a connecting shaft portion 141 at an upper end portion thereof in such a manner as to project transversely inwards, and a connecting shaft portion 142 provided at a lower end portion thereof in such a manner as to project transversely outwards. The key link 14 shifts in a substantially straight line in substantially vertical directions based on the rotation of the key lever 13 to the unlocking direction and the locking direction by the connecting shaft portion 141 that is rotatably connected to an angular hole 131 of the key lever 13 and the connecting shaft portion 142 that is rotatably connected to a rotating end portion of the key sub-lever 15. The key sub-lever 15 is rotatable from a neutral position to an unlocking direction and to a locking direction in accordance with the shifting of the key link 14 (described later).

The key sub-lever 15 is pivotally supported by the same pivot shaft 19 on which the sector gear 10 pivots between the case and the other side 105 of the sector gear 10, in other words, on the other side 105 of the sector gear 10 which confronts the one side 92 of the worm wheel 9. The key sub-lever 15 rotates independently of the sector gear 10 and rotates in synchronism with the operation of the key cylinder from the neutral position (refer to FIGS. 4, 5, 7 and 9) in the unlocking direction (the counterclockwise direction in FIGS. 4, 5 and a clockwise direction in FIGS. 7, 9) and the locking direction (the clockwise direction in FIGS. 4, 5 and the counterclockwise direction in FIGS. 7, 9) by the rotating end portion being connected to the connecting shaft portion 142 of the key link 14.

As is shown mainly in FIGS. 7 to 10, the unlocking abutment portion 151 and the locking abutment portion 152 are provided on the key sub-lever 15 in such a manner as to be spaced apart a predetermined amount from each other in the rotating direction.

Figure 7:
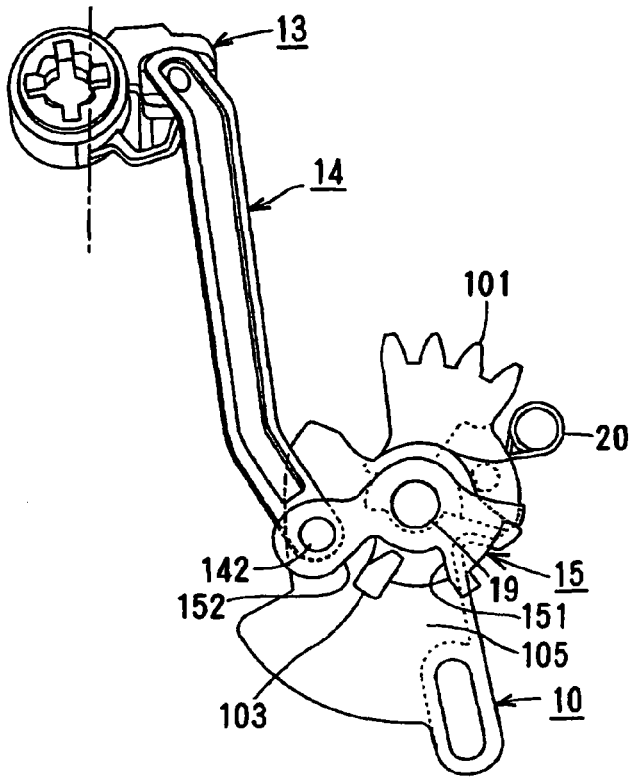
FIG. 7 is a rear view of a main part of the operating mechanism unit when a sector gear is in an unlocking position.
Figure 8:
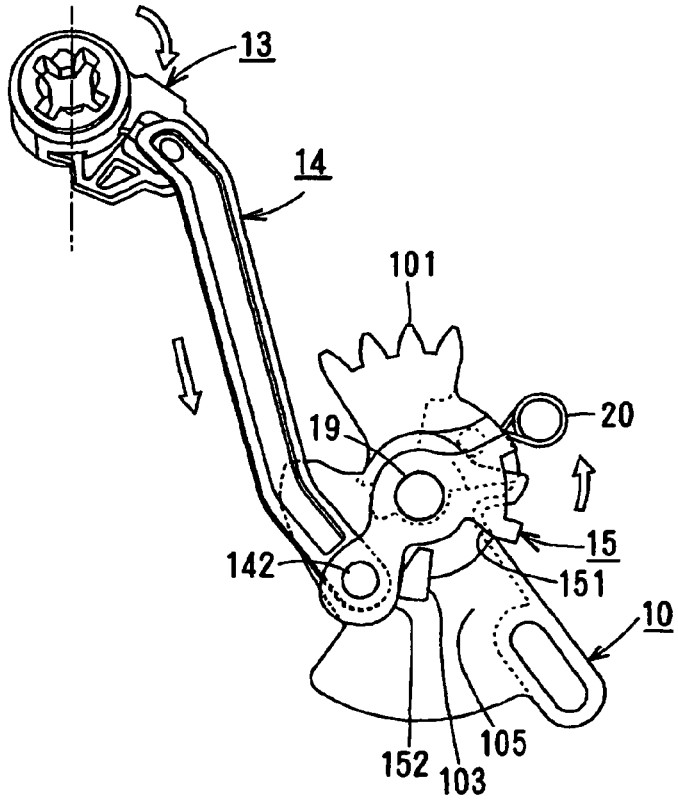
FIG. 8 is a rear view of the main part of the operating mechanism unit when a key sub-lever rotates to a locking direction.
Figure 9:
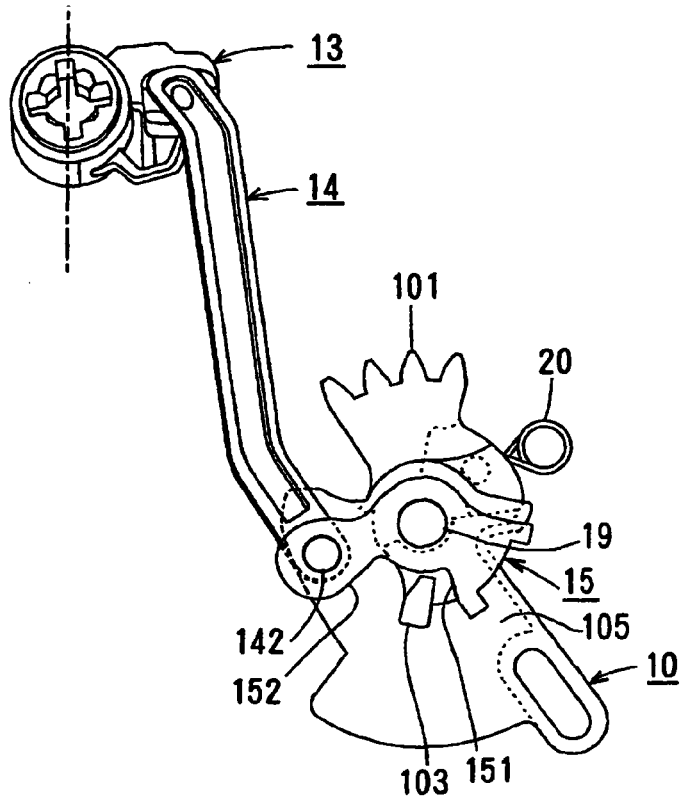
FIG. 9 is a rear view of the main part of the operating mechanism unit when the sector gear is in a locking position.
Figure 10:
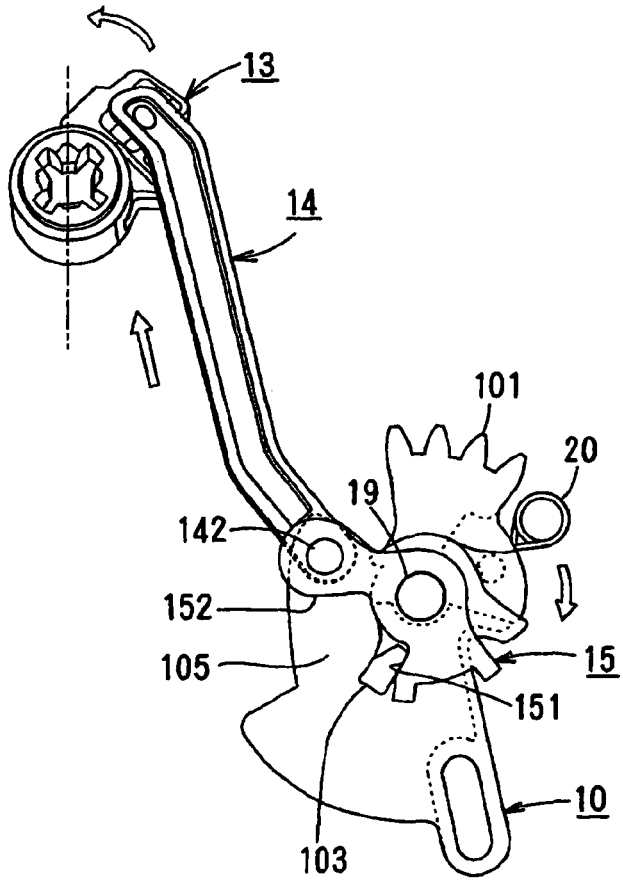
FIG. 10 is a rear view of the main part of the operating mechanism unit when the key sub-lever rotates to an unlocking direction.

By the key sub-lever 15 being caused to rotate from the neutral position in the unlocking direction as is shown in FIG. 9 in synchronism with an unlocking operation of the key cylinder, the unlocking abutment portion 15 is brought into abutment with the abutment portion 103 of the sector gear 10 as is shown in FIG. 10 to thereby rotate the sector gear 10 to the unlocking position. In addition by the key sub-lever 15 being caused to rotate from the neutral position in the locking direction as is shown in FIG. 7 in synchronism with a locking operation of the key cylinder, the locking abutment portion 152 is brought into abutment with the abutment portion 103 of the sector gear 10 as is shown in FIG. 8 to thereby rotate the sector gear 10 to the locking position.

When the key sub-lever 15 is in the neutral position, even though the sector gear 10 rotates from the unlocking position to the locking position or rotates reversely, there occurs no such occasion that the abutment portion 103 of the sector gear 10 is brought into abutment with the unlocking abutment portion 151 and the locking abutment portion 152 of the key sub-lever 15. Namely, the sector gear 10 is linked with the key sub-lever 15 via a play corresponding to an operation stroke between the unlocking position and the locking position thereof.

As has been described above, by pivotally supporting the key sub-lever 15 which operates in synchronism with the operation of the key cylinder on the same pivot 19 on which the sector gear 10 pivots, an operation space where the operation of the key sub-lever 15 is permitted is encompassed within an operation space where the operation of the sector gear 10 is permitted. As a result of this, the necessity is obviated of securing separately the operation space of the key sub-lever 15 outside the operation space of the sector gear 10, whereby the front projection area of the operating mechanism unit 3 can be reduced, thereby making it possible to realize a reduction in size of the operating mechanism unit 3. Furthermore, by disposing the key sub-lever 15 on the other side 105 of the sector gear 10 which confronts the one side 92' of the worm wheel 9 on which the pinion 91 is provided, the sector gear 10 and the key sub-lever 15 can be disposed on the same plane, whereby the transverse thickness of the operating mechanism unit 3 can be reduced.

The lock lever 16 is pivotally supported, outside the cover 7, by the same pivot 19 on which the sector gear 10 pivots on one side 104 of the sector gear 10, in other words, on an opposite side to the side where the key sub-lever 15 is disposed in such a manner as to rotate together with the sector gear 10. A connecting portion 161 which is provided at a rotating end portion is connected to the lock knob via an operation force transmission means 25 such as a Bowden cable. Accordingly, the lock lever 16 is caused to rotate to an unlocking position (refer to FIGS. 1, 4) and a locking position (refer to FIG. 5) together with the sector gear 10. By the lock lever 16 being disposed on the one side 104 of the sector gear 10, the lock lever 16 can be disposed outside the cover 7 with the simple configuration, whereby the operation force transmission member 25 can simply be connected to the connecting portion 161 of the lock lever 16.

The outside lever 18 is pivotally supported at a lower portion within the cover 7 by a pivot 22 which is oriented in the longitudinal direction. Lower portions of the first and second switch levers 11, 12 are connected to an end portion 182 which is oriented transversely inwards in such a manner as to oscillate through a predetermined angle. A connecting portion 181 provided at a transversely outward end portion is connected to the outside handle via an operation force transmission member (not shown). According thereto, the outside lever 18 rotates through a predetermined angle from a waiting position (refer to FIG. 2) in a release direction (a clockwise direction in FIG. 2) based on a door opening operation of the outside handle.

The inside lever 17 is pivotally supported at a lower portion within the cover 7 by a pivot 21 which is oriented in the transverse direction. The inside handle is connected to a connecting portion 171 provided at a lower end portion of the inside lever 17 via an operation force transmission member 26 such as a Bowden cable. According thereto the inside lever 17 rotates through a predetermined angle from a waiting position (refer to FIGS. 4, 5) in a release direction (a clockwise direction in FIGS. 4, 5) based on a door opening operation of the inside handle. An unlocking action of the inside lever 17 in the unlocking direction is transmitted to the outside lever 18 by an abutment portion 172 provided on the inside lever 17 being brought into an abutment portion 183 provided at a lower end portion of the outside lever 18.

The first switch lever 11 is pivotally supported on an end portion 182 of the outside lever at a lower portion thereof in such a manner as to rotate through a predetermined angle in the longitudinal direction. The vertically elongated hole 111 provided in an upper portion of the first switch lever 11 is brought into slidable engagement with the projecting portion 102 of the sector gear 10. According thereto, the first switch lever 11 rotates to an unlocking position (refer to FIG. 4) and a locking position (refer to FIG. 5) in such a manner as to follow the sector gear 10. A bent piece 112 is provided at an upper end portion of the first switch lever 11 in such a manner as to be brought into engagement with the rotation preventive piece 63 of the ratchet 6.

When the ratchet 6 is in an open position with the door opened, the rotation preventive piece 63 of the ratchet 6 is brought into engagement with the bent piece 112 of the first switch lever 11 as is shown in FIG. 14 so as to prevent the rotation of the first switch lever 11 from the unlocking position to the locking position. In contrast, when the ratchet 6 is in an engagement position with the door closed, the rotation preventive piece 63 is withdrawn to a position where the rotation preventive piece 63 cannot be brought into engagement with the bent piece 112. According thereto, the first switch lever 11 is allowed to rotate freely from the unlocking position to the locking position. By this configuration, there occurs no such occasion that the lock knob is erroneously operated to lock the door when the door is opened.

The second switch lever 12 is pivotally supported at the end portion 182 of the outside lever 18 in such a manner as to rotate in the longitudinal direction and in such a manner as to rotate independently of the first switch lever 11. The release portion 121 is provided at an upper end portion of the second switch lever 12 in such a manner as to be brought into engagement with the engagement pin 62 of the ratchet 6.

A spring 27 is provided round the periphery of the end portion 182 of the outside lever 18. The spring 27 is locked on to the first switch lever 11 at one end and is locked on to the second switch lever 12 at the other end thereof, whereby a biasing force is imparted to the second switch lever 12 in a clockwise direction as viewed in FIGS. 4, 5. The second switch lever 12 is normally brought into abutment with the first switch lever 11 in the clockwise direction and is held in a normal position shown in FIGS. 4, 5. Consequently, the first and second switch levers 11, 12 operate together within a range of the holding force of the spring 27.

When the outside lever 18 rotates in the release direction based on the door opening operation of the outside handle or the inside handle, the end portion 182 of the outside lever 18 shifts upwards, and in association with this, the first and second switch levers 11, 12 shift upwards. Under this situation, when the sector gear 10 and the first and second switch levers 11, 12 are in the unlocking positions, the release portion 121 of the second switch lever 12 is brought into engagement with the engagement pin 62 of the ratchet 6 to rotate the ratchet 6 in the release direction, whereby the engagement with the latch 5 is released (refer to FIG. 11). In contrast, when the sector gear 10 and the first and second switch levers 11, 12 are in the locking positions, the release portion 121 of the second switch lever 12 fails to engage with the engagement pin 62 of the ratchet 6, and hence, the second switch lever 12 fails to rotate the ratchet 6 in the release direction (refer to FIG. 12).

Next, operations in respective states of the door latch apparatus according to the embodiment of the invention will be described.

(When the Outside Handle or Inside Handle is Operated While the Door Latch Apparatus is in an Unlocking State)

When the door latch apparatus 1 is in an unlocking state, as is shown in FIG. 4, the sector gear 10, the lock lever 16 and the first and second switch levers 11, 12 are held in the unlocking positions. When the outside lever 18 is caused to rotate in this state based on a door opening operation of the outside handle, the first and second switch levers 11, 12 shift upwards as is shown in FIG. 11, whereby the release portion 121 of the seconds switch lever 12 is brought into engagement with the engagement pin 62 of the ratchet 6. By this action, the ratchet 6 is caused to rotate in the release direction, and the ratchet 6 is disengaged from the latch 5, whereby the door can be opened.

In addition, when the inside lever 17 is caused to rotate in the release direction based on an opening operation of the inside lever, the abutment portion 172 of the inside lever 17 is brought into abutment with the abutment portion 183 of the outside lever 18. According thereto, the outside lever 18 is caused to rotate in the release direction, and the door can be opened in the same way as when the outside handle is operated to open the door.

(When a Control Switch is Operated to Lock the Door while the Door Latch Apparatus is in the Unlocking State)

When the motor 8 rotates forwards based on an operation of a control switch, the rotation of the motor 8 is transmitted to the sector gear 10 via the worm 81, the worm wheel 9, the pinion 91 and the toothed portion 101. By this action, the sector gear 10 and the lock lever 16 rotate about the pivot 19 from the unlocking position shown in FIG. 4 to the locking position shown in FIG. 5. In addition, following the operation of the sector gear 10, the first and second switch levers 11, 12 also rotate from the unlocking positions to the locking positions, whereby a locking state shown in FIG. 5 results. Incidentally, the sector gear 10 and the key sub-lever 15 are linked with each other via the play corresponding to the shift stroke of the sector gear 10 between the unlocking position and the locking position thereof. Thus, even though the sector gear 10 rotates from the unlocking position (refer to FIG. 7) to the locking position (refer to FIG. 9), the rotation of the sector gear 10 is not transmitted to the key sub-lever 15.

(When the Lock Knob is Operated to Lock the Door while the Door Latch Apparatus is in the Unlocking State)

A locking operation of the lock knob is transmitted to the sector gear 10 via the operation force transmission member 25, the connecting portion 161 and the lock lever 16, whereby the sector gear 10 rotates together with the lock lever 16 from the unlocking position to the locking position, and a locking state can be produced in a similar way to when the door is closed by driving the motor 8. In this case, too, as with when the control switch is operated to lock the door, the rotation of the sector gear 10 is transmitted to the key sub-lever 15 in no case.

(When the Key Cylinder is Operated to Lock the Door while the Door Latch Apparatus is in the Unlocking State)

As is shown in FIGS. 4, 7, when the key cylinder is not operated, the key lever 13, the key link 14 and the key sub-lever 15 are held in the neutral positions. When the key cylinder is operated to lock the door in this state, as is shown in FIG. 8, the key lever 13 rotates in the locking direction (a clockwise direction in FIG. 8), the key link 14 shifts downwards, and the key sub-lever 15 rotates in the locking direction (a counterclockwise direction in FIG. 8). By this series of actions, the locking abutment portion 152 of the key sub-lever 15 is brought into abutment with the abutment portion 103 of the sector gear 10, whereby the sector gear 10 rotates to the locking position. In addition, following the operation of the sector gear 10, the first and second switch levers 11, 12 also rotate to the locking positions. After the sector gear 10 and the first and second switch levers 11, 12 have been caused to shift to the locking positions, as is shown in FIG. 9, by the key lever 13, the key link 14 and the key sub-lever 15 being caused to return to the neutral positions and the key being removed from the key cylinder, the locking state shown in FIG. 5 results.

(When the Outside Handle or Inside Handle is Operated While the Door Latch Apparatus is in a Locking State)

When the door latch apparatus 1 is in a locking state, as is shown in FIG. 5, the sector gear 10, the lock lever 16 and the first and second switch levers 11, 12 are held in the locking positions. Even though the outside lever 18 rotates in the release direction in this state based on a door opening operation by the outside handle or inside handle, since the first and second switch levers 11, 12 shift obliquely upwards as is shown in FIG. 12 and the release portion 121 of the second switch lever 12 fails to engage with the engagement pin 62 of the ratchet 6, the ratchet 6 cannot be caused to rotate in the release direction. Consequently, even though the outside handle or the inside handle is operated to open the door, the door cannot be opened.

(When the Control Switch is Operated to Unlock the Door While the Door Latch Apparatus is in the Locking State)

The rotation of the motor 8 is transmitted to the sector gear 10 via the worm 81, the worm wheel 9, the pinion 91 and the toothed portion 101, whereby the sector gear 10 and the lock lever 16 rotate about the pivot 19 to the locking position shown in FIG. 5 to the unlocking position shown in FIG. 4. At the same time, following the operation of the sector gear 10, the first and second switch levers 11, 12 also rotate from the locking positions to the unlocking positions, whereby an unlocking state shown in FIG. 4 is produced. Incidentally, the sector gear 10 and the key sub-lever 15 are linked with each other via the play corresponding to the shift stroke of the sector gear 10 between the unlocking position and the locking position thereof. Thus, even though the sector gear 10 rotates from the locking position (refer to FIG. 9) to the unlocking position (refer to FIG. 7), the rotation of the sector gear 10 is not transmitted to the key sub-lever 15.

(When the Control Switch is Operated to Unlock the Door with a Slight Delay from an Operation of the Outside Handle or the Inside Handle while the Door Latch Apparatus is in the Locking State)

In this case, as is shown in FIG. 12, the first and second switch levers 11, 12 shift obliquely upwards based on a releasing operation of the outside lever 18 to fail to engage with the engagement pin 62 of the ratchet 6, and due to this, the sector gear 10 is caused to rotate from the locking position to the unlocking position by virtue of the rotation of the motor 8. As this occurs, as is shown in FIG. 13, a body portion 122 of the second switch lever 12 is brought into abutment with a distal end of the engagement pin 62 of the ratchet 6, whereby only the sector gear 10 and the first switch lever 11 are allowed to rotate to the unlocking positions against the biasing force of the spring 27 with the second switch lever 12 left staying before the unlocking position. In addition, when the outside lever 18 is caused to return to the waiting position by temporarily stopping the door opening operation by the outside handle or the inside handle, the engagement of the body portion 122 of the second switch lever 12 with the engagement pin 62 of the ratchet 6 is released, whereby the second switch lever 12 is caused to rotate to the unlocking position as shown in FIG. 11 by virtue of the biasing force of the spring 27. In addition, by operating again the outside handle or inside handle to open the door, the door can be opened.

(When the Lock Knob is Operated to Unlock the Door while the Door Latch Apparatus is in the Locking State)

An unlocking operation of the lock knob is transmitted to the sector gear 10 via the operation force transmission member 25, the connecting portion 161 and the lock lever 16, whereby the sector gear 10 is allowed to rotate from the locking position to the unlocking position together with the lock lever 16, so as to realize an unlocking state as in the way in which the unlocking state is realized by virtue of drive of the motor 8. In this case, the rotation of the sector gear 10 is not transmitted to the key sub-lever 15 as in the case of the control switch being operated to lock the door.

(When the Key Cylinder is Operated to Unlock the Door While the Door Latch Apparatus is in the Locking State)

When the key cylinder is not in operation, as is shown in FIGS. 5, 9, the key lever 13, the key link 14 and the key sub-lever 15 are held in the neutral positions. When the key cylinder is operated to unlock the door in this state, as is shown in FIG. 10, the key lever 13 rotates in the unlocking direction (a counterclockwise direction in FIG. 10), the key link 14 shifts upwards, and the key sub-lever 15 rotates to the unlocking direction (a clockwise direction in FIG. 10), whereby the unlocking abutment portion 151 of the key sub-lever 15 is brought into abutment with the abutment portion 103 of the sector gear 10, and the sector gear 10 is caused to rotate to the unlocking position. In addition, the first and second switch levers 11, 12 also rotate to the unlocking positions in synchronism with the rotation of the sector gear 10. After the sector gear 10 and the first and second switch levers 11, 12 have been caused to the locking positions, the key lever 13, the key link 14 and the key sub-lever 15 are caused to return to the neutral positions and the key is removed from the key cylinder, whereby a locking state shown in FIG. 4 can result.

Thus, while the embodiment of the invention has been described heretofore, various changes and/or modifications can be made to the embodiment without departing from the scope of the invention.

For example, the first switch lever 11 and the second switch lever 12 may be formed integrally.

Further, it may be possible to configure such that the key lever 13 and/or the key link 14 is omitted, and a key cylinder is linked with a key sub-lever 15 in such a manner that the key sub-lever 15 rotates based on an operation of the key cylinder.

What is claimed is:

1. A vehicle door latch apparatus comprising:

a meshing mechanism unit that is configured to engage with and disengage from a striker provided on a vehicle body; and an operating mechanism unit that is configured to operate the meshing mechanism unit, wherein the operating mechanism unit comprises:

a gearwheel comprising a pinion on one side thereof;

a motor configured to rotate the gearwheel;

a sector gear, which is pivotally supported by a pivot, which meshes with the pinion, and which is configured to be rotated by the pinion of the gearwheel;

a switch lever connected to the sector gear, wherein the switch lever is shiftable to:

an unlocking position where engagement between the meshing mechanism unit and the striker is releasable; and a locking position where the engagement between the meshing mechanism unit and the striker is unreleasable; and a key sub-lever pivotally supported on the pivot, wherein the key sub-lever is rotatable in an unlocking direction and a locking direction in synchronism with operations of an operation key cylinder provided on an external side of a door, wherein the sector gear and the key sub-lever are pivotally supported on the pivot such that the key sub-lever rotates independently of the sector gear, wherein the sector gear comprises an abutment portion extending in an axial direction of the pivot, and wherein the key sub-lever is configured to be brought into abutment with the abutment portion of the sector gear so as to rotate the sector gear to an unlocking position by being rotated in the unlocking direction and a locking position by being rotated in the locking direction.

2. The vehicle door latch apparatus according to claim 1, wherein the key sub-lever is on a first side of the sector gear, and wherein the sector gear is provided such that the first side of the sector gear faces the one side of the gearwheel.

3. The vehicle door latch apparatus according to claim 2, wherein the operating mechanism unit further comprises a lock lever pivotally supported on the pivot so as to be rotatable together with the sector gear, wherein the lock lever is linked with a lock knob provided on an internal side of the door, and wherein the lock lever is provided on a second side of the sector gear, which is opposite to the first side of the sector gear.

4. The vehicle door latch apparatus according to claim 3, wherein the sector gear, the key sub-lever and the lock lever are pivotally supported on the pivot such that the key sub-lever rotates independently of the sector gear and the lock lever rotates together with the sector gear.

5. The vehicle door latch apparatus according to claim 1, wherein the operating mechanism unit further comprises a given body, wherein the meshing mechanism unit is pivotally fixed to the given body, wherein the meshing mechanism unit further comprises:

a latch, which is pivotally fixed to the given body, and which is engagable with the striker provided on the vehicle body; and a ratchet, which is pivotally fixed to the given body, which is engagable with and disengagable from the latch, and which comprises an engagement pin at a rotating end portion thereof, wherein the switch lever is a first switch lever, wherein the operating mechanism unit comprises a second switch lever being shiftable to an unlocking position and a locking position and wherein the engagement pin is engagable with the second switch lever.

6. The vehicle door latch apparatus according to claim 5, wherein the first and second switch levers are movable in a direction in which the second switch lever engages with the engagement pin when the sector gear and the first and second switch levers are in their respective unlocking positions, and wherein the first and second switch levers are movable in a direction in which the second switch lever fails to engage with the engagement pin when the sector gear and the first and second switch levers are in their respective locking positions.

7. The vehicle door latch apparatus according to claim 5, wherein the sector gear comprises a projecting portion on one side thereof, and wherein the first switch lever is operated to follow a rotation of the sector gear, wherein the first switch lever comprises an elongated hole that is brought into slidable engagement with the projecting portion of the sector gear, and wherein the second switch lever is rotatable independently of the first switch lever and is engagable with the engagement pin.

8. The vehicle door latch apparatus according to claim 7, wherein the operating mechanism unit further comprises a lock lever that is pivotally supported on the pivot, and wherein the sector gear, the key sub-lever and the lock lever are pivotally supported on the pivot such that the lock lever is provided on the one side of the sector gear and the key sub-lever is provided on the other side of the sector gear, the other side of the sector gear facing the one side of the gearwheel.

9. The vehicle door latch apparatus according to claim 1, wherein the operating mechanism unit further comprises:

a given body, to which the meshing mechanism unit is pivotally fixed;

a cover for covering one side of the given body; and an outside lever that is pivotally supported within the cover, the switch lever being connected to an end portion of the outside lever; and an inside lever, which is pivotally supported within the cover, and which is abuttable with the outside lever.

10. A vehicle door latch apparatus comprising:

a meshing mechanism unit that is configured to engage with and disengage from a striker provided on a vehicle body; and an operating mechanism unit that is configured to operate the meshing mechanism unit, wherein the operating mechanism unit comprises:

a gearwheel comprising a pinion on one side thereof;

a motor configured to rotate the gearwheel;

a sector gear, which meshes with the pinion, and which is configured to be rotated by the pinion of the gearwheel;

a switch lever connected to the sector gear, wherein the switch lever is shiftable to (1) an unlocking position where engagement between the meshing mechanism unit and the striker is releasable, and (2) a locking position where the engagement between the meshing mechanism unit and the striker is unreleasable; and a key sub-lever on a first side of the sector gear, wherein the key sub-lever is rotatable in an unlocking direction and a locking direction in synchronism with operations of an operation key cylinder, wherein the key sub-lever is configured to (1) rotate the sector gear to an unlocking position by rotating in the unlocking direction; and (2) rotate the sector gear to a locking position by rotating in the locking direction, wherein the sector gear and the key sub-lever are pivotally supported on a pivot such that the key sub-lever rotates independently of the sector gear.

11. The vehicle door latch apparatus according to claim 10, wherein the operating mechanism unit further comprises a lock lever linked with a lock knob, wherein the lock lever is provided on a second side of the sector gear, which is opposite to the first side of the sector gear, and wherein the sector gear, the key sub-lever and the lock lever are pivotally supported on the pivot such that the lock lever rotates together with the sector gear.

12. The vehicle door latch apparatus according to claim 10, wherein the sector gear is provided such that the first side of the sector gear faces the one side of the gearwheel.

* * * * *